United States Patent [19]

Bjerknes et al.

[11] 4,198,094

[45] Apr. 15, 1980

[54] WORKING CHAIR

[76] Inventors: Anders Bjerknes, Ranunkelveien 3A, Oslo 8, Ruedi à Porta, St. Olavsgt. 7, Oslo 1, both of Norway

[21] Appl. No.: 935,417

[22] Filed: Aug. 22, 1978

[30] Foreign Application Priority Data

Aug. 25, 1977 [NO] Norway ..... 772943

[51] Int. Cl.[2] ..... A47C 1/00

[52] U.S. Cl. ..... 297/306; 297/328

[58] Field of Search ..... 297/306, 300, 328, 374, 297/373, 313, 327, 326, 337

[56] References Cited

U.S. PATENT DOCUMENTS

| | | | |
|---|---|---|---|
| 2,249,828 | 7/1941 | Herold | 297/376 |
| 2,278,080 | 3/1942 | Koenigkramer et al. | 297/328 |
| 2,702,077 | 2/1955 | Hughes | 297/375 |
| 3,989,297 | 11/1976 | Kerstholt | 297/306 |
| 4,101,167 | 7/1978 | Ornberg | 297/328 |

FOREIGN PATENT DOCUMENTS

| | | | |
|---|---|---|---|
| 2630820 | 7/1976 | Fed. Rep. of Germany | 297/328 |
| 2312216 | 1/1977 | France | 297/313 |

*Primary Examiner*—Francis K. Zugel

*Attorney, Agent, or Firm*—Sughrue, Rothwell, Mion, Zinn and Macpeak

[57] ABSTRACT

A working chair comprising a seat member and a back member, each of which is pivotable about a horizontal shaft mounted in an underframe so that the seat and back members are individually adjustable, and a releasable locking means for fixing of the seat and back members in a set position. The locking means comprises a number of locking plates of which a first number of plates is fixed to the underframe at a distance behind the pivot axes of the seat and back members, and a second number of plates is fixed to the back member. The locking plates co-operate with a clamping unit mounted on the underside of the seat member and comprising clamping members for clamping the locking plates therebetween by spring action. Said spring action may be neutralized by means of a manually actuatable handle.

9 Claims, 4 Drawing Figures

WORKING CHAIR

BACKGROUND OF THE INVENTION

The invention relates to an improvement in a working chair comprising a seat member which is pivotable about a horizontal shaft mounted in an underframe, and a back member which is also pivotable about a horizontal shaft mounted in the underframe, so that the seat and back members are individually adjustable, and a releasable locking means for fixing the seat and back members in a chosen position.

In the field relating to workings chairs, i.e., office chairs and the like, there has, during the recent years, been developed various constructions with a view to enable anatomically correct sitting posture in connection with different types of work, such as work at writing tables, typewriters, conveyor belts etc. Apart from the fact that the chair must have adjustable height for adaption to the user in question, it is also essential that a person shall be able to change sitting posture in the course of the working-day, and that the chair shall then give appropriate support in different sitting positions. In this connection it is known to effect adjustment of seat and back linked together so that the chair may be tilted resiliently back and forth. Further, it is known to adjust the seat about an axis beneath the seat, so that the back at any time is supported approximately at the same point.

A chair of the type set forth above represents a substantially advance in this field, as it enables individual adjustment of the seat member and the back member of the chair. The adjustment of seat and back can then take place about the same point, i.e. about the same shaft, or about shafts with different locations.

SUMMARY OF THE INVENTION

The object of the invention is to further develop a working chair of the aforementioned type and to provide such a chair which satisfies a user's requirements with respect to simple as well as rapid and comfortable adjustment, whereby quick adjustment may be carried out with a spring-loaded handle, and only small forces have to be applied in order to set and maintain a desired position, and wherein the chair has a simple and functionally stable locking means.

For the achievement of the above-mentioned objects there is provided a working chair of the type set forth above, wherein, according to the invention, the locking means comprises a number of co-operating locking plates of which a first number of plates is fixed to the underframe at a distance behind the mounting of the seat and back members in the underframe, and a second number of plates is fixed to the back member, the locking plates co-operating with a clamping unit mounted on the underside of the seat member and comprising clamping members between which the locking plates may be clamped by spring action, which spring action can be neutralized by means of a manually actuable handle.

BRIEF DESCRIPTION OF THE DRAWINGS

The invention will be more closely described in the following with reference to the accompanying drawings, wherein.

DETAILED DESCRIPTION OF THE PREFERRED EMBODIMENT

Figure 1:
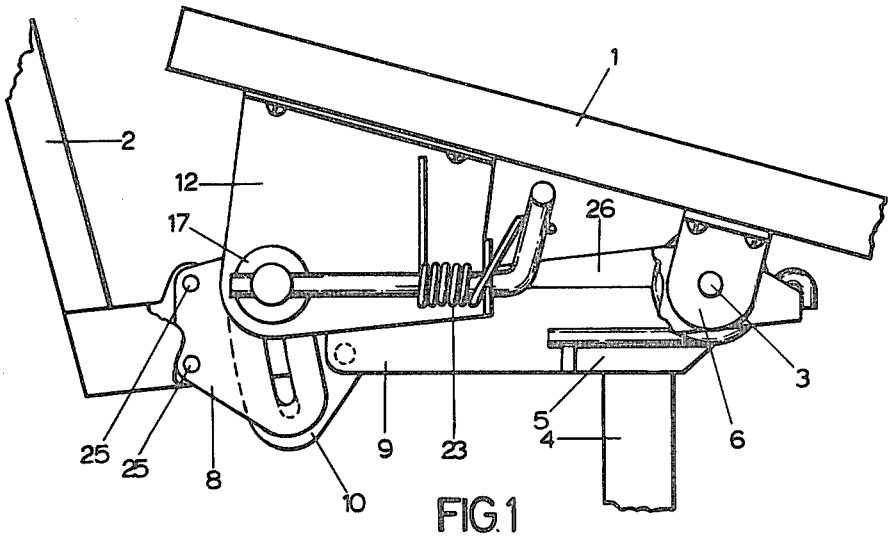
FIG. 1 is a partly sectioned, fragmentary side view of a chair according to the invention.

As it appears from the drawings, the shown chair comprises a seat member 1 and a back member 2, which are both pivotally mounted on a common, horizontal shaft 3 carried by the underframe of the chair. As suggested in FIG. 1, the underframe comprises a post or column 4 and a column mounting 5 fixed to the column and carrying the shaft 3. The shaft may be rotatably or non-rotatably mounted in the column mounting or may be a part of the column mounting, or alternatively consist of pivots extending therefrom. The lower, not illustrated portion of the column may be a part of a height adjustment device of conventional construction with e.g. handle-operated quick-adjustment, and with a suitable suspension.

In the illustrated embodiment, the seat member 1 is freely mounted or journalled on the shaft 3 by means of depending seat brackets 6 and 7, whereas the back member 2 is spring-influenced, as described below, so that in the released position it may be pivoted upwards and forwards towards the seat member.

For locking of the seat member and the back member in relation to each other in a chosen set position, there is provided a locking means comprising a number of co-operating locking plates of which a first number of plates 10 is fixed to a rearwards projecting extension 9 of the column mounting 5 of the underframe, and a second number of plates 8 is fixed to the back member. The locking plates are coupled to and co-operate with a clamping unit 11 mounted on the underside of the seat member 1 and comprise clamping members between which the locking plates may be clamped by spring action, as more closely described below. As a result of the fact that the location of the mounting of the locking plates by means of said column mounting extension 9 is situated at a distance behind the mounting of the seat and back members in the underframe, a long moment arm and correspondingly reduced forces are achieved in order to maintain a set position of the seat and back members, respectively. Thus, a secure locking when the locking is achieved plates are clamped together in locking position.

The clamping unit is mounted in two seat mountings 12 and 13, respectively, depending from the seat member 1 and comprises a screw bolt 14 passing through a hole 15 in one of the seat mountings 13 and screwed into a nut 16 which is slidable in a clamping ring 17, which in turn, is slidably mounted in the other seat mounting 12. The screw bolt 14 passes through slots in the locking plates, said slots being mutually aligned in the traverse direction and extending concentrically with the common axis of rotation of the seat and back members.

Figure 4:
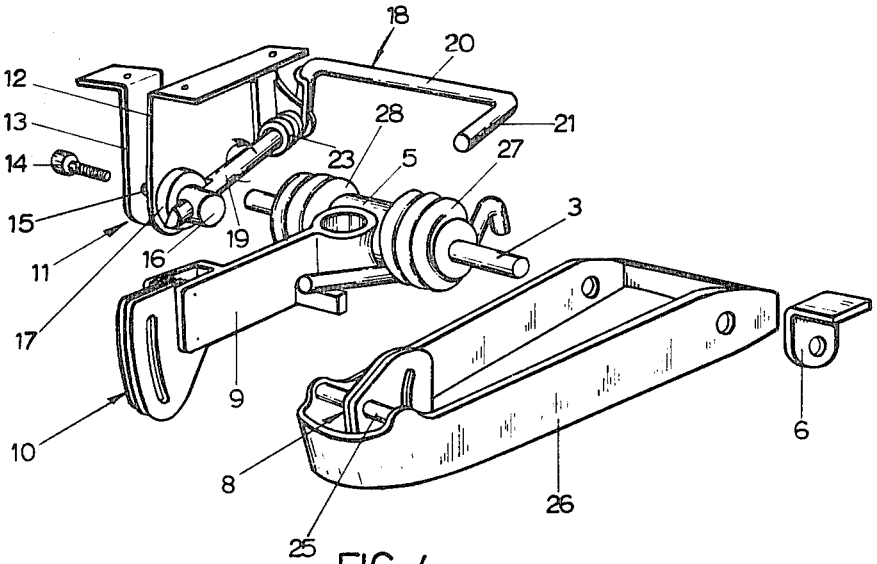
FIG. 4 is an exploded, perspective view of the members shown in FIG. 2.
Figure 1:
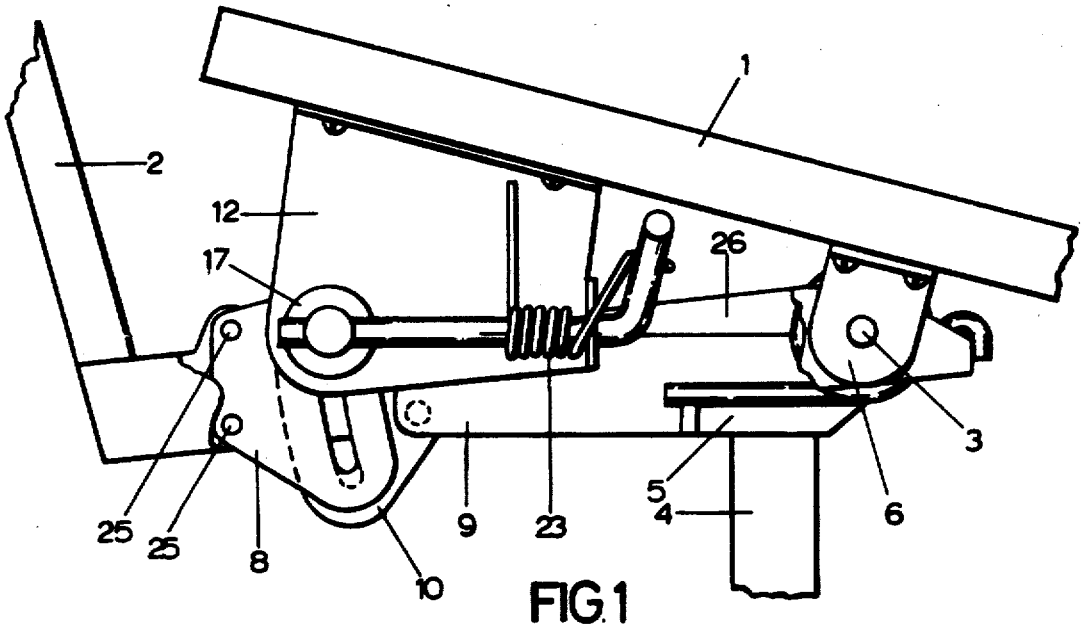

For the operation of the locking means a spring-actuated handle 18 is provided which is essentially L-shaped and has an inner portion 19 extending at right angles to the screw bolt 14, which inner portion is journalled in the seat mounting 12 with the clamping ring 17 and is in engagement with the nut 16, and a transverse outer portion 20 which extends outwardly beneath the seat member and has an outer grip portion 21. In the illustrated embodiment, the end portion of the inner handle portion 19 extends through a hole in the nut 16 and is provided with a pair of recessed 22 forming eccentric portions bearing against the adjacent outer end of the clamping ring 17. A helical spring 23 is located on the inner handle portion, which spring is fixed with its ends between the seat mounting 12 and an up-standing portion of the handle between the outer and inner handle portion. Thus, the helical spring applies a torque (in the direction of the arrow shown in FIG. 4) on the inner handle portion, so that the eccentric portions thereof urge the clamping ring 17 inwards against the locking plates 8 and 10. The locking plates are then pressed against each other and lock the seat member and the back member in their adjusted relative position and in relation to the underframe, the outermost locking plates bearing against the clamping ring and the oppositely located seat mounting, respectively. The force from the locking spring 23 and therewith the locking of the plates may be neutralized in that the grip 21 of the handle is lifted, e.g. by a person sitting on the chair, so that rapid adjustment of back and seat angle may thereafter be carried out. By adjusting the thread engagement between the screw bolt 14 and the clamping nut 16 one may adjust the clearance between the locking plates in their released position.

Figure 2:
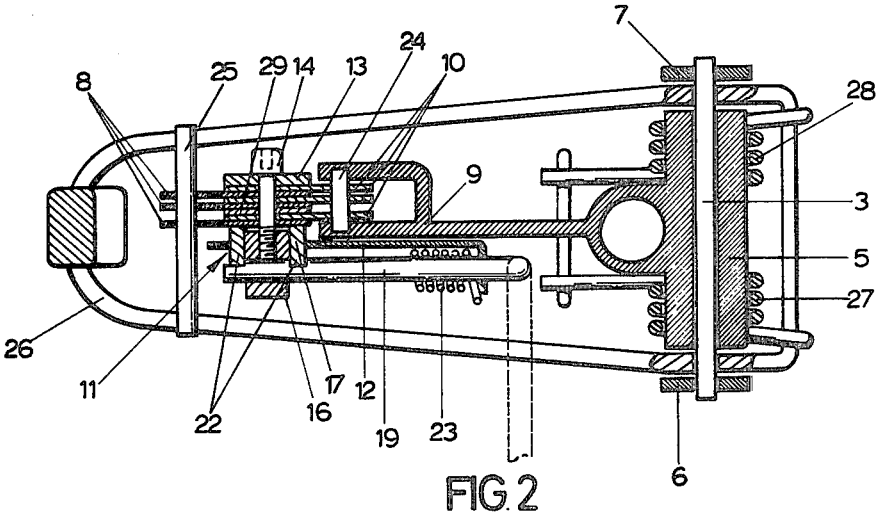
FIG. 2 is a partly sectioned top view of the locking device of the chair and members of the underframe thereof.

It will be realized that the number of locking plates may consist of only one locking plate which is fixed to the underframe, and one locking plate which is fixed to the back member. However, in order to achieve a more secure locking several plates are used to provide more frictional surfaces bearing against each other. The illustrated embodiment comprises three lamella plates fixed to the underframe, and three lamella plates fixed to the back member. Each lamella group is slidably mounted on transversely extending lamella fixing bolts (24, 25). Thus, the underframe or column mount lamellae 10 are fitted on a pair of transversely extending fixing bolts 24 (one bolt is shown in FIG. 2), which are in turn fitted in a fork-shaped holder on the column mount extension 9. Further, the back member lamellae 8 are fitted on a pair of transversely extending fixing bolts 25 fitted between the side members of a back member carrier which is formed as a frame 26 surrounding or encircling the locking means with the lamella plates, the clamping unit and the inner handle portion. Thus, the entire locking means is essentially hidden within the frame 26. As shown, the frame-shaped back member carrier 26 is spring-biased by a pair of tilt springs 27 and 28 in the form of helical springs which are disposed on cylindrical parts of the column mounting 5 and with their ends are fixed between the upper edge of the front portion of the frame and suitable brackets on the column mounting. Thus, in the released position of the locking means, the back member is tilted upwards and forwards towards the seat member.

By means of said slidable mounting of the locking plates or the lamellae, and also the clamping ring slidable in its seat mount, it is achieved that the entire locking means is slidable in the lateral direction, and centering inaccuracies and larger manufacturing tolerances may thereby be allowed.

Figure 3:
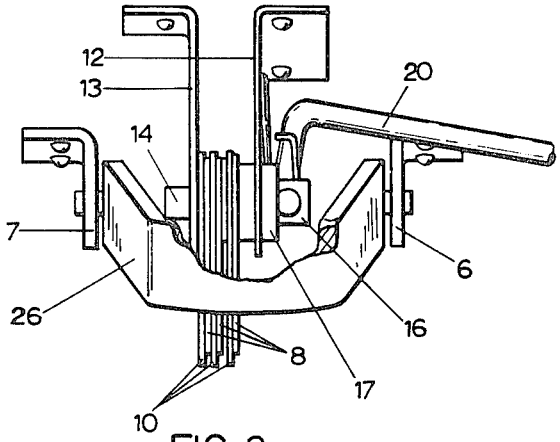
FIG. 3 is a partly sectioned rear view of the locking device and surrounding members of the chair.

Such as appears from the FIGS. 2 and 3, the back member lamellae 8 and the column mount lamellae 10 alternately bear against each other except for a lamella disc 29 which is inserted between a back member lamella and a column mount lamella and disposed on the screw bolt 14. In this way four frictional surfaces are provided in the connection between the two lamella plate groups as well as in the connection between the lamella plates and the seat member, and consequently also equally large frictional forces in said connections.

In addition to the fact that the number of lamella plates may naturally be varied, it is also clear that the described device may also be modified in several other respects without deviation from the fundamental manner of operation. For example, the clamping ring and the clamping nut slidable therein do not have to be cylindrical as shown. Further, for example also the engagement of the inner handle portion with the clamping nut and the eccentric means of the handle portion may be constructed in different ways which will be apparent to a person skilled in the art.

What we claim is:

1. In a working chair including:

an underframe; at least one horizontal shaft mounted in said underframe; a seat member pivotable about said horizontal shaft; a back member pivotable about said horizontal shaft; releasable locking means for fixing said seat and back members in a chosen position relative to each other, said locking means comprising a first number of friction plates connected to said underframe, a second number of friction plates connected to said back member, and clamping means for clamping together said first and second numbers of friction plates; the improvement comprising:

(a) support means for supporting said first number of friction plates at a distance from said horizontal shaft;

(b) a back member carrier fixed to said back member for supporting said second number of friction plates;

(c) a holder attached to the underside of said seat member, said clamping means being mounted in said holder; and (d) spring-actuated handle means mounted in said holder and normally urged against said clamping means to clamp said numbers of friction plates in a desired relative position, said handle means being manually operable to unclamp said clamping means to permit repositioning of said plates.

2. The improvement according to claim 1, wherein said support means for said first number of friction plates projects a distance rearwards from said horizontal shaft in said underframe, and said first number of friction plates are mounted at the rear end of said support means, and wherein said back member carrier projects rearwards from said horizontal shaft with said second number of friction plates mounted between said horizontal shaft and said back member.

3. The improvement according to claim 1, wherein a pair of seat mountings with holes depend from said seat member for mounting said clamping means therein, wherein said clamping means comprises a screw bolt passing through the hole in one said seat mounting and threaded into a nut which is slidable in a clamping ring slidably mounted in the hole in the other said seat mounting, and further wherein said spring-actuated handle means is in engagement with said nut and adapted to urge said clamping ring against an adjacent friction plate.

4. The improvement according to claim 3, wherein said handle means comprises an arm having an end portion passing through a transverse hole in said nut and being provided with at least one eccentric portion for abutment against said clamping ring, and further wherein a locking spring is provided for applying a torque to said end portion of said handle means.

5. The improvement according to claim 3, wherein said seat member and back member are rotatable about a common axis, and said locking plates are provided with aligned slots extending concentrically with said common axis, and through which slots said screw bolt extends.

6. The improvement according to claim 1, wherein said first and second numbers of friction plates are slidably mounted on respective pairs of transverse bolts.

7. The improvement according to claim 6, wherein the transverse bolts for said second number of friction plates are mounted in said back member carrier and wherein said carrier encircles said friction plates, said clamping means and said end portion of said handle means.

8. The improvement according to claim 7, further comprising spring means anchored to said underframe and acting on said back member carrier for urging said back member toward said seat member.

9. The improvement according to claim 3, wherein said first and second numbers of friction plates are arranged in alternating sequence, and further wherein a friction disc is disposed on said screw bolt between two adjacent friction plates and the two outside friction plates bear against said screw-bolt-receiving seat mounting and said clamping ring, respectively.

* * * * *

REEXAMINATION CERTIFICATE (1442nd)

United States Patent [19] [11] B1 4,198,094

Bjerknes et al. [45] Certificate Issued Apr. 2, 1991

[54] WORKING CHAIR

[76] Inventors: Anders Bjerknes, Ranunkelveien 34, Olso 8; Reudi á Porta, St. Olavsgt. 7, Oslo 1, both of Norway

Reexamination Request:
No. 90/002,112, Aug. 20, 1990

Reexamination Certificate for:

| | |
|---|---|
| Patent No.: | **4,198,094** |
| Issued: | **Apr. 15, 1980** |
| Appl. No.: | **935,417** |
| Filed: | **Aug. 22, 1978** |

[30] Foreign Application Priority Data

Aug. 25, 1977 [NO] Norway ..... 772943

[51] Int. Cl.[5] ..... A47C 1/00

[52] U.S. Cl. ..... 297/306; 297/374; 297/328

[58] Field of Search ..... 297/300, 306, 313, 326–328, 297/337, 373, 374

[56] References Cited

FOREIGN PATENT DOCUMENTS 7239551 9/1973 Fed. Rep. of Germany .

*Primary Examiner*—Peter R. Brown

[57] ABSTRACT

A working chair comprising a seat member and a back member, each of which is pivotable about a horizontal shaft mounted in an underframe so that the seat and back members are individually adjustable, and a releasable locking means for fixing of the seat and back members in a set position. The locking means comprises a number of locking plates of which a first number of plates is fixed to the underframe at a distance behind the pivot axes of the seat and back members, and a second number of plates is fixed to the back member. The locking plates co-operate with a clamping unit mounted on the underside of the seat member and comprising clamping members for clamping the locking plates therebetween by spring action. Said spring action may be neutralized by means of a manually actuatable handle.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–9 is confirmed.

* * * * *